US005403642A

United States Patent [19]

Landi et al.

[11] Patent Number: 5,403,642

[45] Date of Patent: Apr. 4, 1995

[54] FLEXIBLE HONEYCOMB ARTICLE FOR SCRUBBING, BATHING, WASHING AND THE LIKE

[75] Inventors: Curtis L. Landi; Susan L. Wilson, both of Sunnyvale, Calif.

[73] Assignee: Supracor Systems, Inc., Sunnyvale, Calif.

[21] Appl. No.: 184,575

[22] Filed: Jan. 21, 1994

[51] Int. Cl.[6] ..... B32B 3/12

[52] U.S. Cl. ..... 428/116; 4/606; 52/806

[58] Field of Search ..... 428/116, 118; 156/197, 156/292; 52/806; 4/606

[56] References Cited

U.S. PATENT DOCUMENTS

| | | | |
|---|---|---|---|
| 4,422,183 | 12/1983 | Landi et al. | 428/116 X |
| 4,485,568 | 12/1984 | Landi et al. | 428/116 X |
| 5,039,567 | 8/1991 | Landi et al. | 428/116 |
| 5,122,405 | 6/1992 | Landi | 428/116 |
| 5,134,790 | 8/1992 | Woitschaetzke et al. | 428/116 X |
| 5,180,619 | 1/1993 | Landi et al. | 428/116 |
| 5,203,607 | 4/1993 | Landi | 428/116 X |
| 5,277,389 | 1/1994 | Ballares et al. | 428/99 X |
| 5,312,666 | 5/1994 | Jovanovic | 428/99 X |

*Primary Examiner*—Henry F. Epstein
*Attorney, Agent, or Firm*—Claude A. S. Hamrick

[57] ABSTRACT

A flexible honeycomb apparatus for scrubbing, bathing, washing humans and inanimate items, including a first panel, a first handling means, and a second handling means. The first panel includes a honeycomb core formed of undulated strips of resilient thermoplastic material, thermal compression bonded together at a plurality of bond joints to form cell walls defining a plurality of contiguous regularly shaped cells. The core has a first surface formed at a first extremity of the cell wall, a second surface formed at a second extremity of the cell wall, a first length edge oriented parallel to the bond joints, a second length edge oppositely disposed and parallel to the first length edge, a first width edge oriented perpendicular to the bond joints, and a second width edge oppositely disposed and parallel to the first width length. The first handling means, used to handle the core, is heat bonded to the first width edge, the bonding being accomplished by simultaneously applying heat and pressure to the joinder of the first handling means and the first width edge. The second handling means, also used for handling the core, is similarly heat bonded to the second width edge.

30 Claims, 4 Drawing Sheets

FLEXIBLE HONEYCOMB ARTICLE FOR SCRUBBING, BATHING, WASHING AND THE LIKE

BACKGROUND TO THE INVENTION

1. Field of the Invention

The present invention relates generally to an article for scrubbing, bathing, and washing humans and inanimate items, and more particularly to such an article having at least one flexible thermoplastic honeycomb panel.

2. Description of the Prior Art

Sponges, loofahs, brushes and washcloths are well known implements for scrubbing, bathing, and washing persons and inanimate items (e.g. cars, floors, basins, shower stalls etc.). These devices, although widely used, have numerous shortcomings and deficiencies. Sponges, for example, are low in durability and break apart and crumble after prolonged use. In addition, sponges, are not stiff devices and do not provide a rigid surface for scrubbing skin (e.g. elbows, backs, heels) and/or scouring items (e.g. pots, pans, wash basins, tiled surfaces). Also, not all sponges are absorbent. Synthetic sponges, for example, have virtually no water absorbency and therefore do not create adequate sudsing action. Natural sponges, although absorbent, dry very slowly and promote bacterial and fungal growth which leads to the eventual ruination of the device. Sponges are typically small devices and, unless mounted to an extension rod or similar member, cannot be used as a back scrubber or to access other out-of-reach areas. Finally, sponges are not readily foldable and pliable and cannot be used to wash intricately shaped items; they are bulky devices that are difficult to hang or stow in the cramped confines of a shower.

Loofahs share many of the shortcomings of sponges. For example, loofahs do not readily absorb liquids and are not very durable since they typically break or crumble apart after a period of use. Loofahs are typically small items and also not suited as a back scrubbing device. Loofahs, although small, are bulky items that are not easily stowed or hung. Finally, they are not pliable or flexible and cannot be used to scour, scrub, or wash finely curved or otherwise intricately detailed surfaces.

Washcloths are similarly deficient devices because they are very prone to fungal and bacterial infestation and are frequently ruined by such infestation and must be discarded. Additionally, washcloths are not readily foldable and pliable, and cannot be used to wash or scrub surfaces that are finely curved or intricately shaped.

Lastly, sponges, loofahs, brushes, and washcloths are isotropic in nature; their properties for stiffness, hardness, etc. are identical in all directions. For example, a brush will feel, to the user, equally stiff or "bristly" regardless of the direction in which it is applied over the user's skin. A single brush could not be used to scrub or wash areas of the body having significantly different sensitivities (e.g. a heel area and a sunburned arm). Therefore, in order to adequately wash these two different body areas, two distinct devices are required thereby increasing costs to the user.

Thus there is a need for an article for scrubbing, bathing, and washing animate and inanimate items that overcomes the deficiencies of the prior art.

SUMMARY OF THE INVENTION

Objects of this Invention

It is therefore an object of the present invention to provide an article for scrubbing, washing, or bathing humans and inanimate items, wherein the article has at least one thermoplastic elastomeric honeycomb panel.

Another objective of the present invention is to provide an article that has varying characteristics in different areas of the thermoplastic elastomeric honeycomb panel.

Still another objective of the present invention is to provide an article that is highly liquid absorbent, yet does not promote bacterial and fungal growth.

Yet another objective of the present invention is to provide an article that is highly flexible, yet has a surface sufficiently roughened for stimulating the skin area of a person or for scrubbing and scouring pans, pots and the like.

Yet still another objective of the present invention is to provide an article that is highly foldable and pliable, but durable and tear resistant.

Briefly, a flexible honeycomb article for scrubbing, washing, and bathing humans and inanimate items, includes a first panel, a first handling means, and a second handling means. The first panel includes a honeycomb core formed of undulated strips of resilient thermoplastic material, thermal compression bonded together at a plurality of bond joints to form cell walls defining a plurality of contiguous regularly shaped cells. The core has a first surface formed at a first extremity of the cell wall, a second surface formed at a second extremity of the cell wall, a first length edge oriented parallel to the bond joints, a second length edge oppositely disposed and parallel to the first length edge, a first width edge oriented perpendicular to the bond joints, and a second width edge oppositely disposed and parallel to the first width length. The first handling means, used to handle the core, is heat bonded to the first width edge, the bonding being accomplished by simultaneously applying heat and pressure to the joinder of the first handling means and the first width edge. The second handling means, also used for handling the core, is similarly heat bonded to the second width edge.

An important advantage of the present invention is that the thermoplastic elastomeric honeycomb panel used in the article can be constructed of materials that are anti-bacterial and anti-fungal.

Another advantage of the present invention is that the cellular construct of the core provides a plurality of receptacles for water or liquid thereby increasing the absorbency of the device.

Still another advantage of the present invention is that the first and second extremities of the cell walls serve as scrubbing surfaces for scouring, scrubbing, or stimulating the washed surface.

Yet another advantage of the present invention is that the thermoplastic elastomeric honeycomb panel used in the article can be constructed such that different areas of the panel have varying amounts of hardness and flexibility.

These and other objects and advantages of the present invention will no doubt become apparent to those skilled in the art after having read the following detailed description of the preferred embodiment which is contained in and illustrated by the various drawing figures.

DETAILED DESCRIPTION OF THE PREFERRED EMBODIMENT

Figure 1:
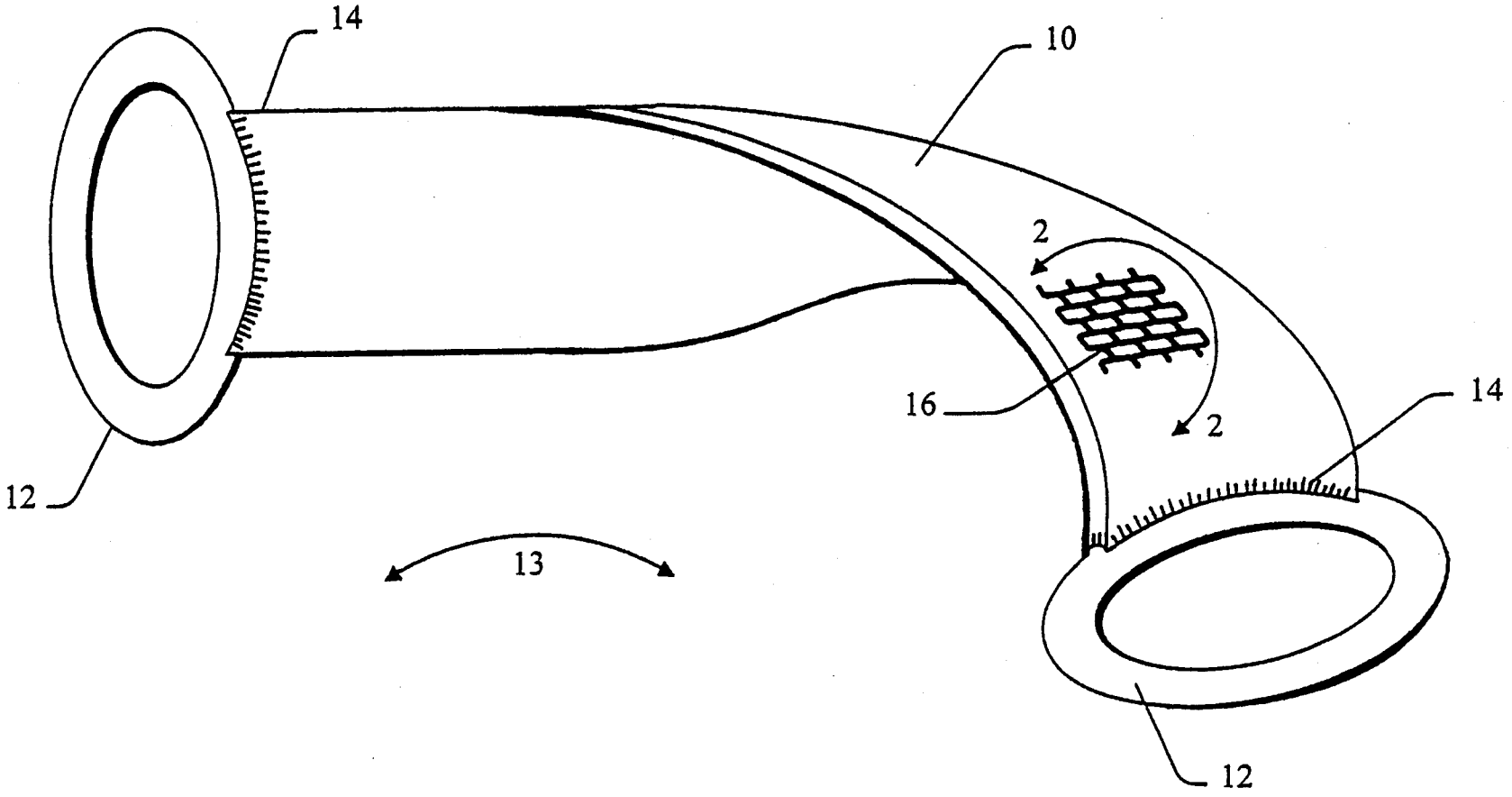
FIG. 1 illustrates an article of the present invention having one flexible thermoplastic elastomeric honeycomb panel.

FIG. 1 shows an article 10 of the present invention having a single flexible thermoplastic elastomeric honeycomb panel 16. A plurality of handles 12 are attached, via a heat weld 14 to the ends of the panel 16. The handles in the preferred embodiment, are typically urethane tubing or similar material.

Figure 2:
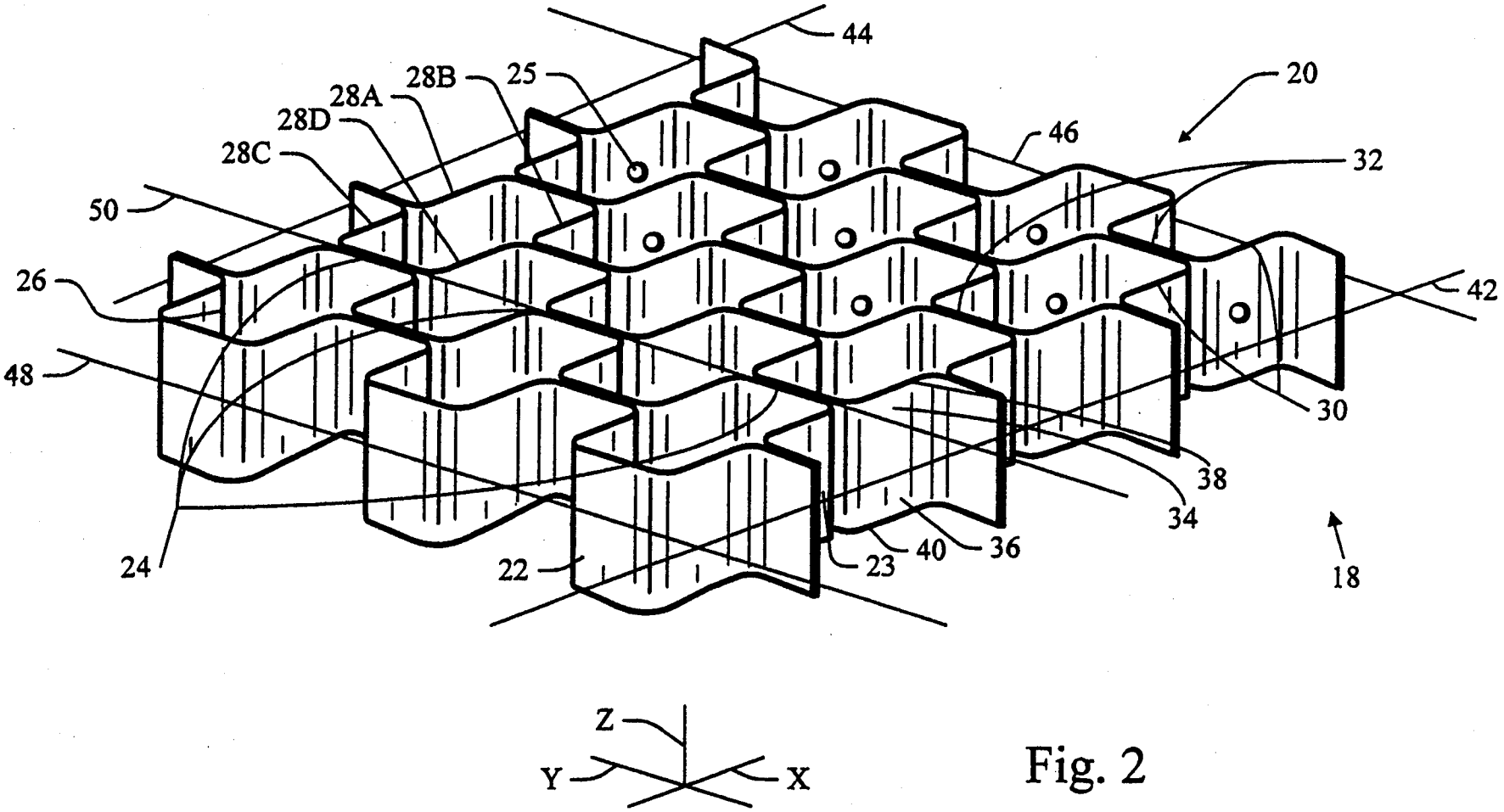
FIG. 2 is a perspective view depicting the flexible honeycomb stock from which the article, illustrated in FIG. 1, is fashioned.

The novelty of this invention is in the use of a layer or layers of thermoplastic elastomeric honeycomb structure paneling 16 as the major component of the article. FIG. 2 illustrates a piece of honeycomb stock 18 from which the panel 16 is cut. The stock 18 includes a block of honeycomb structured core 20 made of thermoplastic material. The honeycomb core 20 is made from strips or ribbons 22 and 23 of an advance grade thermoplastic elastomeric material some of which have been perforated such that a matrix of small holes 25 exist throughout. Although only several sheets have been illustrated as perforated it will be appreciated that in some embodiments, none or all of sheets will be perforated. The sheets are compression bonded together at bond joints 24 which are set at spaced intervals staggered between alternate sheets. This pattern of bonding creates a honeycomb network of elongated, generally hexagonally shaped cells 26 when the bonded stack of ribbons is expanded as described in our copending U.S. patent application Ser. No. 07,446,320 filed Dec. 4, 1989, now U.S. Pat. No. 5,039,567 and incorporated herein by reference.

Each cell 26 of the honeycomb core 20 is defined by four generally S-shaped wall segments 28A–D, each of which is shared by an adjacent cell. The wall segments of each cell 26 include single thickness wall portions 30 and double thickness wall portions 32, the latter portions being disposed on each side of the cell where the side wall's one cell is compression bonded to the side wall of an immediately adjacent cell.

Upper and lower extremities 34, 36 of walls forming the several cells may be deformed, during a planarization operation, as disclosed in our above-identified U.S. Patent to create upper and lower surfaces 38, 40 of the honeycomb core 20. The core is characterized by four edges depicted at 42, 44, 46 and 48. Edges 42 and 44 are parallel to each other; edges 46 and 48 are parallel to each other. Edges 42 and 44 are defined as width edges and are perpendicular to a line 50 drawn through the bond joints 24. Edges 46 and 48 are defined as length edges and are parallel to the line 50.

The panel 16 is then cut from this honeycomb stock 18, to fabricate the article 10, and the handles 12 are attached to either the length edges 46 and 48, or the width edges 42 and 44. The resulting article is a device that is anisotropic in terms of flexibility and can be made with varying areas of stiffness, highly absorbent, antifungal and anti-bacterial, highly tear resistant and durable, and extremely lightweight.

An important quality of this panel is that it is an anisotropic 3-dimensional structure which has varying degrees of flex along its width (X), length (Y), and thickness (Z) dimensions. When the handles are attached, as illustrated in FIG. 1, the primary rubbing motion of the device tends to be along the direction depicted by the arrow 13 (FIG. 1). Thus, in terms of FIG. 2, the primary rubbing motion direction could be directed either along the width (X) or length (Y) dimensions of the core. Motion along the width (X) would correspond to attaching the handles to the edges 46 and 48; while, motion along the length (Y) would correspond to attaching the handles to the edges 42 and 44. If the handles are attached to the width edges 42 and 44 then the primary rubbing motion of the device would run in the direction of the row of bond joints 24 (i.e. along the direction of the line 50 and the double wall portions of the cells). In contrast, if the handles are attached to the length edges 46 and 48 then the primary rubbing motion would run across the row of bond joints 24 (i.e. perpendicular to the line 50 and the double wall portions of the cells). Thus, the flexibility of the device and the sensations imparted to the user would be significantly different depending on the where the handles were attached. This is especially significant, as will be described below, when the device includes two or more panels.

Selected combinations of elastomeric material, honeycomb cell configuration and core thickness will determine a panel's softness or hardness, resilient recovery rate, rigidity or flex. Additionally, by selection and combination of the ribbons 22, 23 that make up the honeycomb core of the panel, the resultant panel can be made with stiffness varying from one area of the panel to the other. For example, one panel can be made to have a greater durometer, i.e. stiffness, and lesser flexibility in one area of the panel and a lesser durometer and greater flexibility in another area of the panel.

A stiffer panel, that is one with a higher durometer (typically between 70–80), is especially advantageous for use as a scrubbing device similar to the loofah found in prior art. Such a stiff scrubbing device would be highly useful in stimulating the skin surfaces of bathers, e.g. backs, heels, elbows. In addition, if the durometer of the panel were increased to a higher level, the resulting panel could be used as a scouring pad for scrubbing pots, pans, basins, tubs, etc.

The honeycomb structure, by its nature, is flexible. However, perforating the cell walls would increase flexibility because there is less material to constrain each segment of the material from bending. This is a significant advantage because increased flexibility allows the panel to be compressed into a tight ball, which is particularly useful for scrubbing purposes, yet the panel may be expanded to be used to cover broad areas or may be used to reach around the back of a bather.

The strips 22, 23 can be manufactured from TPE ether material resulting in stock 20 that is anti-bacterial and anti-fungal. Also, the cells of the honeycomb structure provide many receptacles for holding liquid. Perforating the cell walls increases the absorbency because the perforations act as additional receptacles for liquid. Thus, the device is highly absorbent but also does not promote fungal and bacterial growth.

The honeycomb panel is tear resistant and highly resilient, but extremely light weight. Bare honeycomb (without facing) is 93 percent air. Honeycomb with perforated cell walls would appreciably reduce the weight of the panel because the perforations reduce the overall quantity of material comprising the honeycomb facings.

Figure 3:
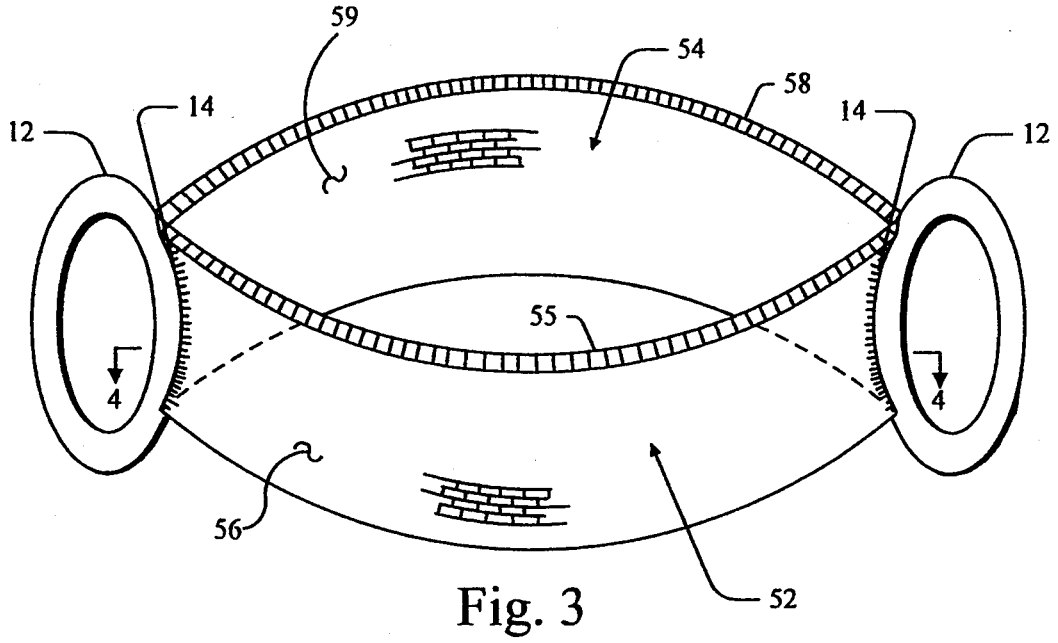
FIG. 3 shows an alternative embodiment of the article of the present invention having two flexible thermoplastic elastomeric honeycomb panels.
Figure 4:
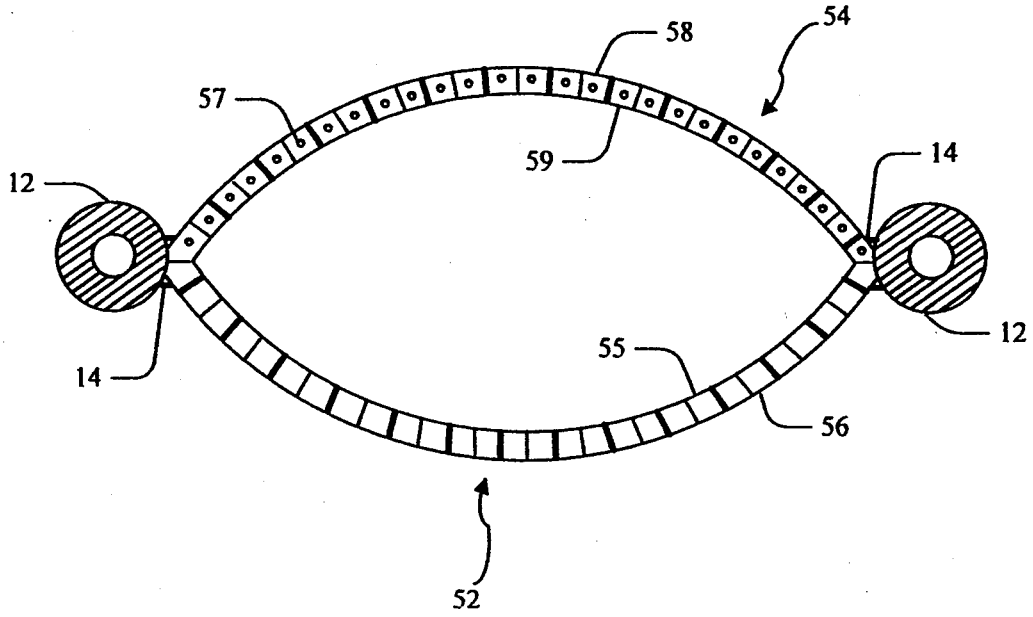
FIG. 4 is a cross sectional view of the article illustrated in FIG. 3.

Turning now to FIG. 3 which illustrates an alternate embodiment of the article depicted in FIG. 1, wherein the article includes two flexible honeycomb panels 52, 54. The individual panels 52 and 54 are joined together at their respective ends to the handles 12, via the heat weld joints 14. FIG. 4 illustrates a sectional view of the embodiment illustrated in FIG. 3. The panels 52 and 54 may be identical in construction having identical elastomer materials, cell configurations, and core thicknesses. In the alternative, as illustrated, the panels may be dissimilar in materials, cell configurations or core thicknesses. In the illustrated embodiment, panel 54 has a perforated core 57, and panel 52 has a non-perforated core. The panels may be joined such that handle 12 joins panel 52 along its length edge and panel 54 along its width edge (or vice versa). When configured in this manner a single article will have two different scrubbing and stimulating sensations depending on which panel, 54 or 52, is applied against the skin.

An inner surface 55 and an outer surface 56 of the panel 52 may have different characteristics, i.e. the outer surface may be planarized while the inner surfaced is not or visa versa. Similarly, with regard to the panel 54, an outer surface 58 may be planarized while an inner surface 59 is not, and the reverse is also possible. A planarized surface is somewhat flattened thereby reducing the scrubbing and scouring sensation. A non-planarized surface is not flattened and therefore provides a more suitable surface for scouring and scrubbing.

Figure 5:
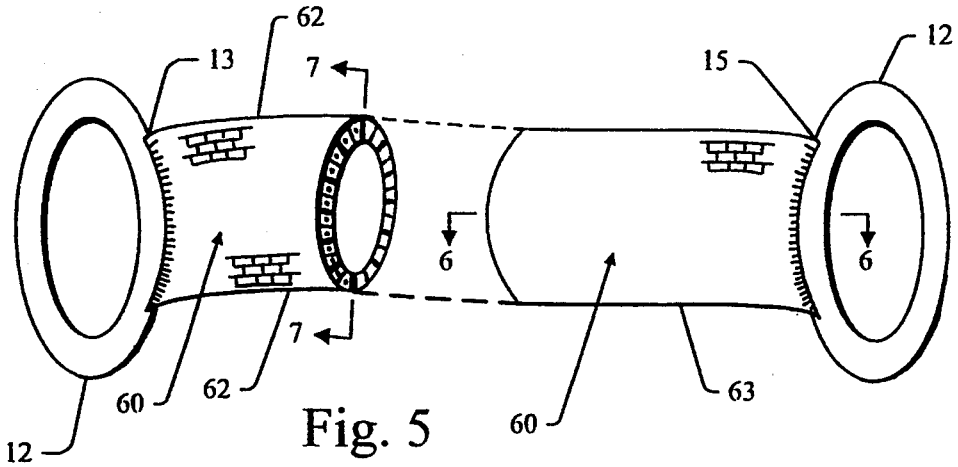
FIG. 5 illustrates yet another embodiment of the article of the present invention having a flexible thermoplastic elastomeric honeycomb panel rolled up into a generally cylindrical or tubular shape; the figure is broken into two halves to illustrate alternate embodiments of this configuration.
Figure 6:
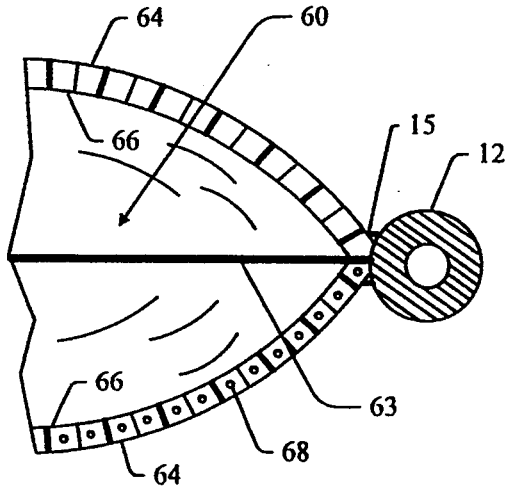
FIG. 6 is a cross sectional view, taken along the line 6—6, of a portion of the article illustrated in FIG. 5.
Figure 7:
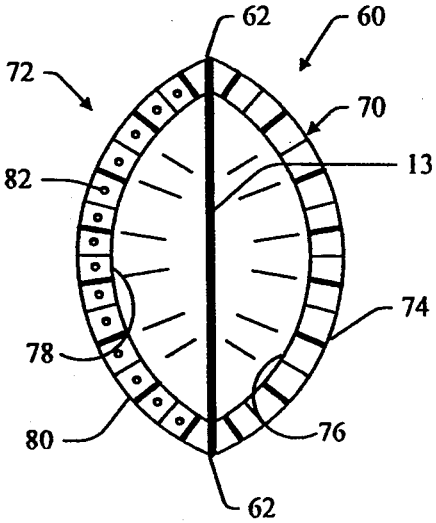
FIG. 7 is a cross sectional view, taken along the line 7—7, of a portion of the article illustrated in FIG. 5.

FIG. 5 illustrates another embodiment of the present invention. A honeycombed panel 60, of similar construction to that illustrated in FIG. 2, is rolled into the shape of a tube or cylinder and is fastened back onto itself along two edges at a weld joint 63, and to handles 12 at the two other edges at weld joints 15, 17. FIG. 5 is broken so that alternate embodiments of this construction are illustrated. FIGS. 6 and 7 are cross-sectional views taken through the lines 6—6 and 7—7, respectively, of FIG. 5.

Referring now to FIGS. 5 and 6, the panel 60 is constructed from a single panel. The panel 60 is folded back onto itself, so as to resemble a tube, and is joined together, at joint 62, along either the width edges or the length edges of its core (e.g. along edge 42 and 44, or along edges 46 and 48 of the core 20 of FIG. 2). It should be noted that, as an alternative, once the 62 is made, the panel 60 could be folded inside-out, such that the joint 62 is on the inside of the tubular structure. In this manner, any rough and sharp edges that may be formed with the weld joint 62 are shielded from the skin of the user. The remaining open ends of the tube are joined together, at joint 15, 17, to the handles 12. The outer surface 64 of the panel may be planarized while the inner surface 66 is not, or vice versa. In addition, some or all of the cells of the panel 60 may be constructed with perforated cell walls in order to increase the flexibility and absorbency of the panel. As illustrated, in FIG. 6, the perforations 68 are formed through only half of the cell walls of the panel 60; although it is quite possible to alternate areas on the panel with perforated and non-perforated cell walls (not shown). Also, although not illustrated in the figure, strips of differing durometers may be employed in the construction of the panel 60 thereby creating portions of the panel with varying degrees of flexibility.

In the alternative, as illustrated in FIG. 7, the panel 60 may be constructed from a plurality of sub-panels that are heat welded together to form one continuous panel that is ultimately configured into the tubular or cylindrical shape illustrated. FIG. 7 depicts two sub-panels 70 and 72 which are welded together, at weld joints 62, to form the tubular or cylindrically-shaped panel 60. The characteristics of each individual sub-panel 70, 72 may be varied as discussed above relative to a single panel. Thus, the individual sub-panels may be constructed with different elastomeric materials for their respective strips, or with different the core configurations or thicknesses. In addition, one sub-panel may have a perforated core (as illustrated by perforations 82 in sub-panel 72), while the other sub-panel 70 is not perforated. Also, the respective inner and outer surfaces, i.e. 78, 80 for panel 72 and 74, 76 for panel 70, for each sub-panel may or not be planarized. Furthermore, the constituent sub-panels 70, 72 may be attached to the handle 12 such that panel 70 is attached along its "length" edge, while panel 72 is attached along its "width" edge. In this manner, the panel 60 will impart two unique scrubbing and stimulating sensations to the user depending on which sub-panel 70 or 72 is applied against the skin of the user.

Although only two sub-panels have been illustrated, in the alternative, a single panel 60 may be constructed out of a plurality of different sub-panels having differing core thickness, cell configurations, or materials. Each of the constituent panels would be joined together via a heat weld joint to construct a tubular panel as illustrated in the figures.

Although preferred, and alternate embodiments of the present invention have been disclosed above, it will be appreciated that numerous alterations and modifications thereof will no doubt become apparent to those skilled in the art after having read the above disclosures. It is therefore intended that the following claims may be interpreted as covering all such alterations and modifications as fall within the true spirit and scope of the invention.

What is claimed is:

1. A flexible honeycomb article for scrubbing, washing, and bathing humans and inanimate items, comprising:

(1) means for scrubbing, washing, bathing humans and inanimate items including a first panel having (a) a honeycomb core formed of undulated strips of resilient thermoplastic material, thermal compression bonded together at a plurality of bond joints to form cell walls defining a plurality of contiguous regularly shaped cells, said core having a first surface formed at a first extremity of said cell wall, a second surface formed at a second extremity of said cell wall, a first length edge oriented parallel to said bond joints, a second length edge oppositely disposed and parallel to said first length edge, a first width edge oriented perpendicular to said bond joints, and a second width edge oppositely disposed and parallel to said first width length;

(2) first means for handling said core, said first handling means heat bonded to said first width edge, the bonding being accomplished by simultaneously applying heat and pressure to the joinder of said first handling means and said first width edge; and (3) second means for handling said core, said second handling means heat bonded to said second width edge, the bonding being accomplished by simultaneously applying heat and pressure to the joinder of said second handling means and said second width edge.

2. A flexible honeycomb article as recited in claim 1, wherein said core includes:

(1) said first handling means being heat bonded to said first length edge, the bonding being accomplished by simultaneously applying heat and pressure to the joinder of said first handling means and said first length edge; and (2) said second handling means being heat bonded to said second length edge, the bonding being accomplished by simultaneously applying heat and pressure to the joinder of said second handling means and said second length edge.

3. A flexible honeycomb article as recited in claim 2, wherein said cell walls of at least some of said cells of said first panel have perforations therein.

4. A flexible honeycomb article as recited in claim 3 wherein at least one of said surfaces of said first panel is planarized.

5. A flexible honeycomb article as recited in claim 2, wherein at least one of said surfaces of said first panel is planarized.

6. A flexible honeycomb article as recited in claim 1, wherein said cell walls of at least some of said cells of said first panel have perforations therein.

7. A flexible honeycomb article as recited in claim 6, wherein at least one of said surfaces of said first panel is planarized.

8. A flexible honeycomb article as recited in claim 1, wherein at least one of said surfaces of said first panel is planarized.

9. A flexible honeycomb article as recited in claim 1 further including:

(1) a second panel including (a) a honeycomb core formed of undulated strips of resilient thermoplastic material, thermal compression bonded together at a plurality of bond joints to form cell walls defining a plurality of contiguous regularly shaped cells, said core having a first surface formed at a first extremity of said cell wall, a second surface formed at a second extremity of said cell wall, a first length edge oriented parallel to said bond joints, a second length edge oppositely disposed and parallel to said first length edge, a first width edge oriented perpendicular to said bond joints, and a second width edge oppositely disposed and parallel to said first width length;

(2) said first handling means heat bonded to said first width edge of said first panel and said first width edge of said second panel, the bonding being accomplished by simultaneously applying heat and pressure to the joinder of said first handling means and said first width edge of said first panel and said first width edge of said second panel; and (3) said second handling means heat bonded to said second width edge of said first panel and said second width edge of said second panel, the bonding being accomplished by simultaneously applying heat and pressure to the joinder of said second handling means and said second width edge of said first panel and said second width edge of said second panel.

10. A flexible honeycomb article as recited in claim 9, wherein said cell walls of at least some of said cells of said first panel have perforations therein.

11. A flexible honeycomb article as recited in claim 10 wherein said cell walls of at least some of said cells of said second panel have perforations therein.

12. A flexible honeycomb article as recited in claim 11, wherein at least one of said surfaces of said first panel is planarized.

13. A flexible honeycomb article as recited in claim 12, wherein at least one of said surfaces of said second panel is planarized.

14. A flexible honeycomb article as recited in claim 9, wherein at least one of said surfaces of said first panel is planarized.

15. A flexible honeycomb article as recited in claim 14, wherein at least one of said surfaces of said second panel is planarized.

16. A flexible honeycomb article as recited in claim 1 further including:

(1) a second panel including (a) a honeycomb core formed of undulated strips of resilient thermoplastic material, thermal compression bonded together at a plurality of bond joints to form cell walls defining a plurality of contiguous regularly shaped cells, said core having a first surface formed at a first extremity of said cell wall, a second surface formed at a second extremity of said cell wall, a first length edge oriented parallel to said bond joints, a second length edge oppositely disposed and parallel to said first length edge, a first width edge oriented perpendicular to said bond joints, and a second width edge oppositely disposed and parallel to said first width length;

(2) said first handling means heat bonded to said first width edge of said first panel and said first length edge of said second panel, the bonding being accomplished by simultaneously applying heat and pressure to the joinder of said first handling means and said first width edge of said first panel and said first length edge of said second panel; and (3) a second means for handling said core, said second handling means heat bonded to said second width edge of said first panel and said second length edge of said second panel, the bonding being accomplished by simultaneously applying heat and pressure to the joinder of said second handling means and said first width edge of said first panel and said second length edge of said second panel.

17. A flexible honeycomb article as recited in claim 16, wherein said cell walls of at least some of said cells of said first panel have perforations therein.

18. A flexible honeycomb article as recited in claim 17, wherein said cell walls of at least some of said cells of said second panel have perforations therein.

19. A flexible honeycomb article as recited in claim 18, wherein at least one of said surfaces of said first panel is planarized.

20. A flexible honeycomb article as recited in claim 19, wherein at least one of said surfaces of said second panel is planarized.

21. A flexible honeycomb article as recited in claim 16, wherein at least one of said surfaces of said first panel is planarized.

22. A flexible honeycomb article as recited in claim 21, wherein at least one of said surfaces of said second panel is planarized.

23. A flexible honeycomb article for scrubbing, washing, and bathing, or scrubbing humans and inanimate items, comprising:

(1) means for scrubbing, washing, and bathing, or scrubbing humans and inanimate items, including at least one panel having (a) a honeycomb core formed of undulated strips of resilient thermoplastic material, thermal compression bonded together at a plurality of bond joints to form cell walls defining a plurality of contiguous regularly shaped cells, said core having a first surface formed at a first extremity of said cell wall, a second surface formed at a second extremity of said cell wall, a first length edge oriented parallel to said bond joints, a second length edge oppositely disposed and parallel to said first length edge, a first width edge oriented perpendicular to said bond joints, and a second width edge oppositely disposed and parallel to said first width length, said first and said second length edges heat bonded together by simultaneously applying heat and pressure to the joinder of said edges so that said panel is generally cylindrical shaped;

(2) first means for handling said core, said first handling means heat bonded to said first width edge, the bonding being accomplished by simultaneously applying heat and pressure to the joinder of said first handling means and said first width edge; and (3) second means for handling said core, said second handling means heat bonded to said second width edge, the bonding being accomplished by simultaneously applying heat and pressure to the joinder of said second handling means and said second width edge.

24. A flexible honeycomb article as recited in claim 23, wherein at least one of said surfaces of said panel is planarized.

25. A flexible honeycomb article as recited in claim 23, wherein said cell walls of at least some of said cells of said first panel have perforations therein.

26. A flexible honeycomb article as recited in claim 25, wherein at least one of said surfaces is planarized.

27. A flexible honeycomb article as recited in claim 23, wherein said core includes:

(1) said first width edge and said second width edge being heat bonded together by simultaneously applying heat and pressure to the joinder of said edges so that said panel is generally cylindrical shaped;

(2) said first handling means being heat bonded to said first length edge, the bonding being accomplished by simultaneously applying heat and pressure to the joinder of said first handling means and said first length edge; and (3) said second handling means being heat bonded to said second length edge, the bonding being accomplished by simultaneously applying heat and pressure to the joinder of said second handling means and said second length edge.

28. A flexible honeycomb article as recited in claim 27, wherein at least one of said surfaces of said panel is planarized.

29. A flexible honeycomb article as recited in claim 27, wherein said cell walls of at least some of said cells of said panel have perforations therein.

30. A flexible honeycomb article as recited in claim 29, wherein at least one of said surfaces of said panel is planarized.

* * * * *